US005347982A

United States Patent [19]

Binzer et al.

[11] Patent Number: 5,347,982

[45] Date of Patent: Sep. 20, 1994

[54] FLAME MONITOR SAFEGUARD SYSTEM

[75] Inventors: Lothar Binzer, Surrey; Didace E. Morrissette, Union Bay; Ronald Toth, Burnaby, all of Canada

[73] Assignee: Canadian Heating Products Inc., Surrey, Canada

[21] Appl. No.: 120,165

[22] Filed: Sep. 10, 1993

Related U.S. Application Data

[63] Continuation-in-part of Ser. No. 995,361, Dec. 21, 1992, abandoned.

[51] Int. Cl.[5] ..... F24B 1/187

[52] U.S. Cl. ..... 126/503; 126/512; 431/47; 431/69; 431/73; 431/255

[58] Field of Search ..... 431/6, 25, 47, 69, 46, 431/73, 78; 126/502, 503, 512

[56] References Cited

U.S. PATENT DOCUMENTS

| | | | |
|---|---|---|---|
| 3,938,935 | 2/1976 | Engelbert | 431/47 |
| 4,019,854 | 4/1977 | Carlson | 431/69 |
| 4,111,639 | 9/1978 | Matthews | 431/46 |
| 4,726,351 | 2/1988 | Whittaker et al. | 126/512 |

*Primary Examiner*—Carroll B. Dority

*Attorney, Agent, or Firm*—Flehr, Hohbach, Test, Albritton & Herbert

[57] ABSTRACT

A gas burning fireplace having a burner for producing a flame. A rod in the vicinity of the burner. A gap between the burner and the rod and wherein a flame is produced in the gap. An apparatus for monitoring the presence of a flame including a battery for applying a DC voltage between the rod and the burner. An electric circuit means for sensing a DC current between the rod and the burner.

5 Claims, 3 Drawing Sheets

33

V bat
S1A
IRFD 9123
V1
R2
28
S1B
26
16
A1
R3
C1
R4
Vcc
R5
A2
R6
R7
R8
R9
C2
D1
R10
C4
D6
LMC 555
CON
TRIG
THRES
RST
OUT
DIS
2N7000
D2
D5
D3
D4
IRFZ34
22
52

FLAME MONITOR SAFEGUARD SYSTEM

This application is a continuation-in-part of application Ser. No. 07/995,361, filed Dec. 12, 1992, now abandoned.

FIELD OF THE INVENTION

This invention relates to flame generating appliances. More particularly, this invention relates to a flame monitor safe guard system which provides a method of responding rapidly to a pilot or main flame failure to shut off the gas flow to the burner(s).

BACKGROUND OF THE INVENTION

Decorative and functional flame generating appliances often rely on combustion of natural gas, propane, and other liquid petroleum fuels to generate a flee. Known methods of flame supervision involve various automatic thermal sensing devices such as thermocouples and optical means of determining flame condition. Many fireplaces use a thermopile which, when heated, generates a small voltage which is applied to a relay to hold open a valve controlling the flow of gas to the fireplace. Such fireplaces typically use a pilot flame which is ignited by manually controlling the gas flow by holding open the valve and igniting the gas by means of a piezo electric spark generator. The thermopile is arranged in proximity to the pilot burner. Once the pilot flame has been established sufficiently long to heat up the thermopile, the thermopile voltage will act to hold open the valve controlling the supply of gas thereby enabling the pilot flame to remain lit when the operator releases manual control of the valve and enabling the operator to activate the main burner. When the main burner selection is made, gas flows through the burner bar which then ignites from the established pilot flame.

One problem with the above method is that when the pilot or main flame condition has been lost, it can take up to three minutes of cool down time before the thermopile will cease generating current so as to shut off the gas supply valve. This allows sufficient time to establish a high concentration of combustible gas in the combustion chamber, particularly if it is closed or sealed. Since most of the gases involved are colourless and in many cases undetectable, dangerous combustion conditions may fail to be recognized, resulting in hard lights or explosions occurring. To prevent this from occurring, it is also known to provide electronic flame supervision using an AC rectification system to monitor the presence of a flame.

A flame rectification system converts alternating current into direct current. The system applies an AC voltage to the flame rod and after the pilot flame is ignited the gas molecules between the flame rod and ground becomes ionized and have the ability to conduct an electrical current. Due to the difference between the grounding area and the flame rod size, the current through to flame flows mostly in one direction. This process results in a pulsating direct current which the flame monitoring circuit in the module is designed to accept. The system is adapted to respond only to this direct current in detecting the presence of flame.

This approach has the advantage of rapid shut off (unlike the thermopile), however, such systems may fail altogether during power outages when operation of the fireplace may be desired.

One object of this invention is to provide a rapid flame failure response which does not depend on an AC supply or a flame rectification system. Another object of this invention is to provide a rapid flame failure response in conjunction with a thermopile based flame monitor as a complete system and which may be retrofitted to a thermopile based fireplace.

SUMMARY OF THE INVENTION

This invention is based on the discovery that, when a pilot flame is established and a DC voltage is applied between a flame rod and the hood of the pilot assembly, a small current flows between them. This current is presumed to rely on the ionization of the gases and air in the gap between the flame rod and the hood.

In one of its aspects, the invention consists of providing ionization based flame sensing using DC power from a battery and circuitry to detect the presence of a flame.

In another of its aspects, the invention consists of relying on ionization based flame sensing to interrupt the current supplied by the thermopile to the gas flow control valve.

In yet another of its aspects., the invention consists of providing a flame rod which relies on the detection of a current between the rod and the hood when a DC voltage is applied. The rod is made part of an electronic control circuit which immediately interrupts the thermopile current to the gas flow control valve when the pilot flame is lost. A lock-out of pre-determined duration is also provided to ensure sufficient time for mechanical purging of accumulated gas before the thermopile current to the gas flow control valve is re-enabled.

DESCRIPTION OF THE PREFERRED EMBODIMENTS

The invention may be understood by reference to the following description of the preferred embodiment in conjunction with the drawings wherein.

Figure 1:
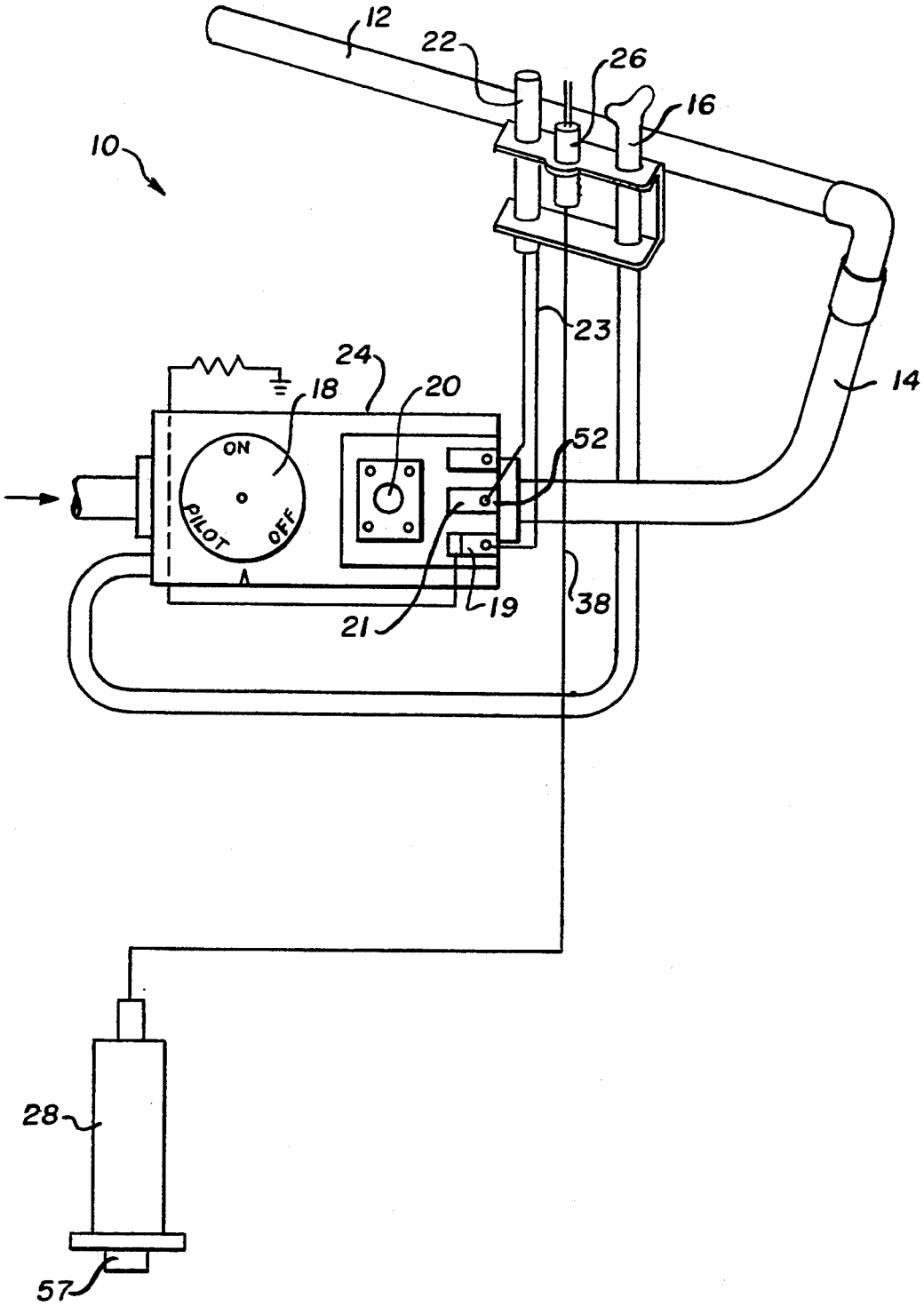
Fig. 1. (PRIOR ART)
FIG. 1 illustrates the burners and controls for a conventional gas fireplace which uses a thermopile to monitor the presence of a pilot flame.

Referring to FIG. 1, there is shown the general arrangement of a conventional gas burning appliance 10 using a thermopile 22 to monitor the presence of a pilot flame. A main burner 12 is supplied with gas through conduit 14 controlled by a valve (not shown) in valve assembly 24.

As is known, the valve may be manually opened for the purpose of igniting the pilot burner 16 by setting the valve control knob 18 to the pilot position and holding it pressed in. In some appliances, a separate button may be provided.

Actual ignition of the gas emitted from the pilot burner 16 is achieved by manually triggering piezo generator 28 by means of igniter button 57 causing a high voltage to be supplied to sparking rod 26 by means of conductor 38. Sparking rod 26 is in the vicinity of the pilot burner 16 and a gap extends between the rod 26 and the burner 16, as is well known. The high voltage causes a spark to jump between the sparking rod 26 and pilot burner 16.

Thermopile 22 is connected to a ground or common lead 21 of valve assembly 24 by means of conductor 25.

Once the pilot burner 16 has ignited, a pilot flame is produced in the gap. The thermopile 22 begins to heat up so as to generate a control voltage which is transmitted by conductor 23 to lead 19 of assembly 24 which includes valve control means (for example a valve coil not shown in FIG. 1 but illustrated in coil 52 in the circuit diagram of FIG. 3). The valve control means hold open the valve when the control voltage is applied to lead 19. This control voltage enables the valve to remain open once the thermopile heats up and begins generating the voltage, thereby continuing the supply of gas to the pilot burner 16.

Thermopile 22 is electrically connected to transmit the control voltage to the valve coil 52 during normal operation when a pilot flame is present. In FIG. 1, this transmission is shown from thermopile 22 via conductor 23 to valve coil lead 19. When the thermopile heats up, a voltage is applied to valve coil lead 19 to hold open the gas flow valve.

Figure 2:
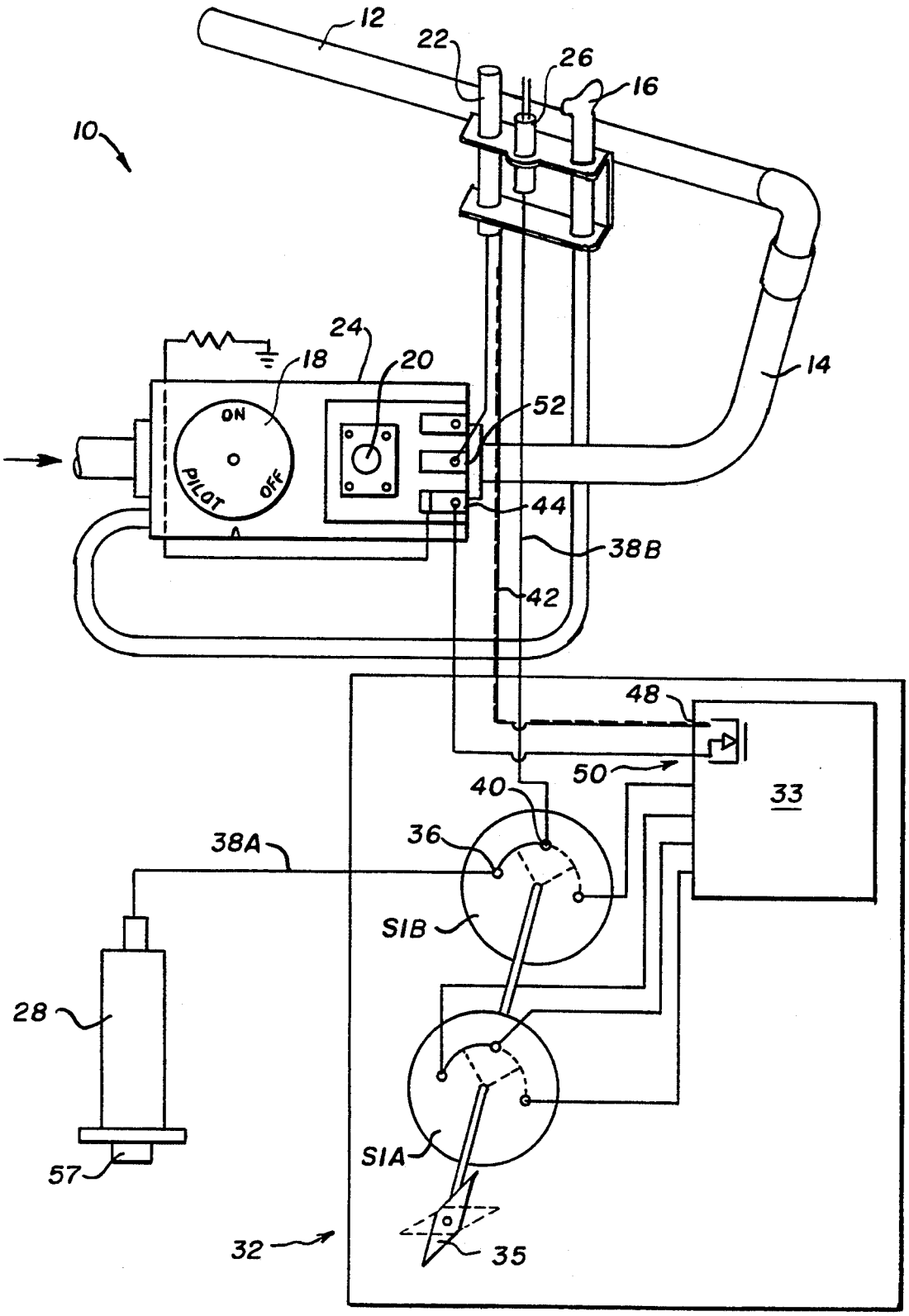
FIG. 2 illustrates a gas fireplace according to the invention.

The preferred embodiment of the invention consists of incorporating assembly 32 into the appliance 10 as shown in FIG. 2. For convenience, like elements in FIGS. 1 and 2 have been assigned the same numerals.

Assembly 32 comprises a control knob 35 for controlling single pole double throw switches S1B and S1A, an electronic logic control circuit indicated generally by the numeral 33 in FIG. 2 and terminals 36, 40, 48 and 50.. The control circuit 33 is described in more detail below.

Retrofitting assembly 32 into the gas fireplace of FIG. 1 is achieved by modifying the electrical connection 38A from the piezo generator 28 so that it is routed to a terminal 36 of the assembly 32 and from terminal 40 of the assembly the electrical connection 38B is made to the sparking rod 26. An electrical connection 42 from the thermopile 22 is routed through terminal 48 to the assembly 32. The control knob 35 is used to control two switches S1B and S1A in a single throw double pole arrangement, the functions of which are more particularly described below. It will be appreciated that pilot burner 16 is grounded through the frame of the pilot burner assembly.

As in the prior art, ignition of the pilot burner is achieved by creating a spark between the sparking rod 26 and the pilot burner assembly 16. This is done while knob 18 is set to "pilot" and is held down. Control knob 35 must also be set so that switch S1B establishes a connection between the piezo generator 28 and the sparking rod 26. Once the pilot has ignited and has heated up thermopile 22, button 20 may be released. Knob 18 may then be turned to "on" to supply gas to the main burner 12.

Figure 3:
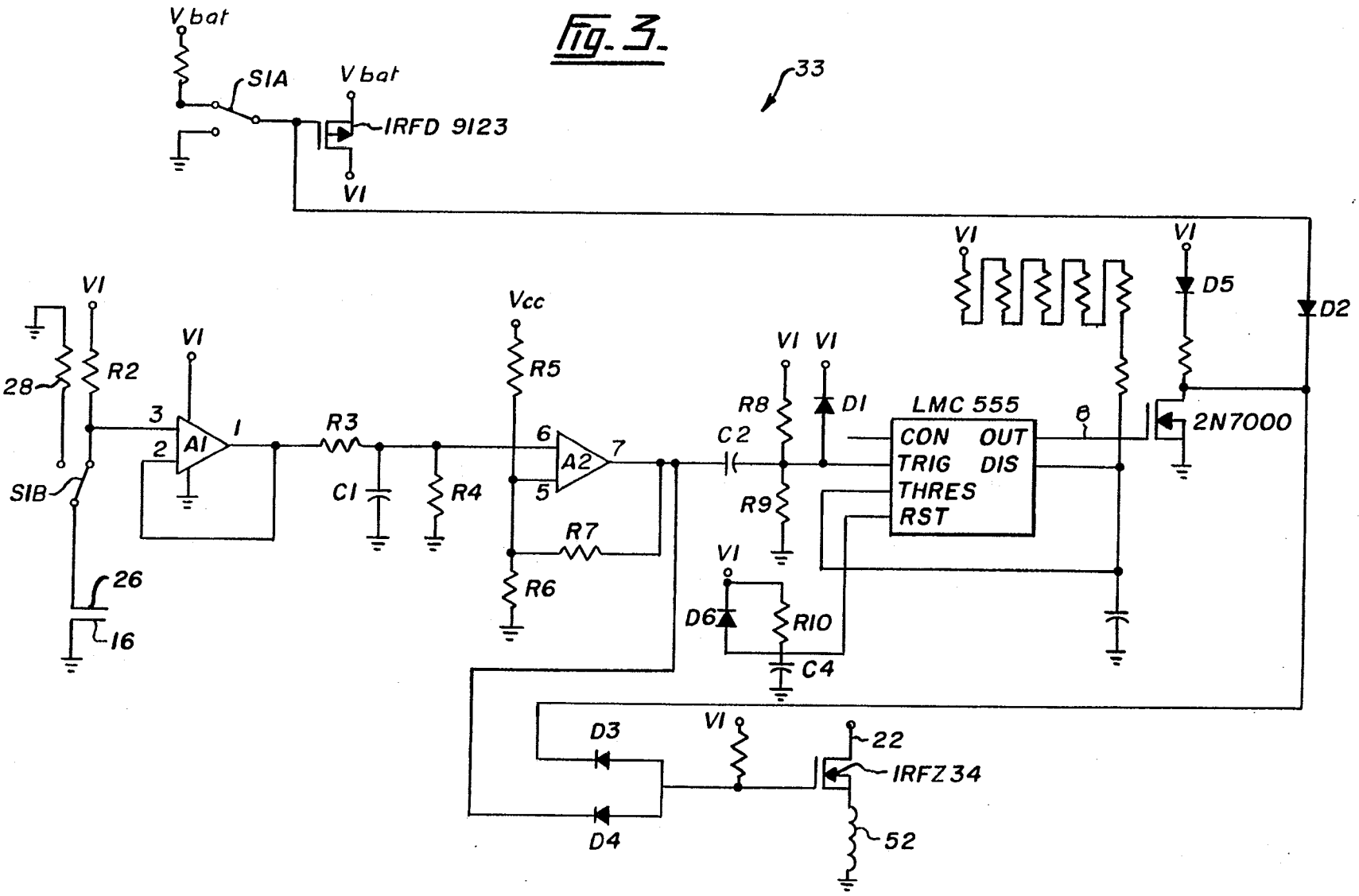
FIG. 3 is a diagram of the control circuit according to the invention.

FIG. 3 illustrates a control circuit 33 embodied in assembly 32 in diagrammatic form. The control circuit 33 includes a battery (indicated as V bat) which supplies DC voltage between the sparking rod 26 and the pilot burner 16, and which also powers the control circuit 33, by the application of voltage V1 through IRFD 9123 which is a P-channel MOSFET device. The control circuit 33 detects the presence of a small DC current between the sparking rod 26 and the pilot burner 16. When such a current is detected, control circuit 33 operates to interrupt the transmission of the control voltage from thermopile 22 to the valve coil 52 as described in more detail below.

Switches S1B and S1A are arranged as a double pole single throw switch. One pole (S1B) provides high isolation for switching the sparking rod 26 between the sparking and the flame sensing modes. The other pole (S1A) is used for applying power from the battery to the control circuit 33. IRFD 9123 is used as a high side switch. When the gate is high, the MOSFET is in the off position and no power is provided to the circuit. When the switch S1A is set to ground the gate is pulled low and power is provided to the circuit.

FIG. 3 illustrates switch S1A in position to cause the rod 26 to be in the flame sensing mode. In the absence of a flame, no current will flow across the gap between the sparking rod 26 and the pilot burner 16. The voltage at terminal 3 of the op-amp A1 will be approximately the logic voltage, V1 provided by the battery assumed to be 9 volts for this embodiment. Op-amp A1 is a buffer and the output at terminal 1 should be approximately 8 volts (there is approximately 1 volt lost due to the saturation of the op-amp). Op-amp A2 is an inverting comparator with hysteresis. The components R3, R4, and C1 between the two op-amps form a filter which eliminates small transients due to wind gusts, etc. In the absence of flame, these will of course have no effect, but they do form a voltage divider which reduces the input voltage to the op-amp A2 (pin 6) to approximately 7.7 volts. The output of the comparator will be near ground. This will cause diode D4 to conduct pulling the gate of MOSFET IRFZ34 low. MOSFET IRFZ34 is in the off state when its gate is low, so that the thermopile voltage is not applied to the valve coil 52. This will prevent the valve from operating.

The presence of a pilot flame results in ionization of the air surrounding the sparking rod. This will allow a small current to flow between the sparking rod and the pilot burner reducing the impedance between them from infinite to a high level. The gap will therefore act as a voltage divider with resistor R2. The voltage at terminal 3 of the op-amp A1 will be approximately 4.5 volts. Op-amp A1 is a buffer and will have an output at pin 1 of 4.5 volts. The filter network will reduce this voltage to approximately 4.3 volts. This is below the trip level of the inverting comparator, so that the output of op-amp A2 will be high (approx. 8 volts). In this case diode D4 will not conduct and the gate of MOSFET IRFZ34 will be high and the MOSFET will conduct. This allows thermopile power to the valve so that it may operate.

The control circuit 33 also provides means for triggering a lockout of predetermined duration when there is flame failure. This prevents reignition until the combustion products have dissipated. In the event of a flame failure, the high to low transition at the output of op-amp A2 (pin 7) will trigger an electronic 555 timer for a predetermined lock-out duration. The 555 timer output (pin 8) is normally low, but goes high in the event of a flame failure. This signal is inverted using MOSFET 2N7000, giving a low level signal in the event of a lockout. As a result, diode D3 will conduct, pulling the gate of IRFZ34 low so as to turn off the MOSFET and thermopile energy is prohibited from reaching the valve. As well, diode D2 conducts which pulls the gate of IRFD 9123 low, ensuring that it stays on providing power to the circuit for the duration of the lockout, regardless of the position of the control switch. Components C2, RS, R9 and D1 form an integrator which ensures that the 555 timer receives a clean trigger signal upon flame failure. Components D6, R10 and C4 form a ramp circuit which keeps the 555 timer reset for a brief period after power is applied to the circuit. This prevents it from receiving spurious signals at power-up which could falsely trigger it into a lockout.

It will be appreciated by those skilled in the art that certain modifications or substitutions may be made to the preferred embodiment described herein, including the use of electrical equivalents, without departing from the principles of the invention.

What I claim is:

1. In a gas burning fireplace having a burner for producing a flame, a rod in the vicinity of the burner, a gap between the burner and the rod and wherein the flame is produced in said gap, apparatus for monitoring the presence of a flame comprising battery means for applying a DC voltage derived from said battery between the rod and the burner, and electronic circuit means for sensing a DC current between the rod and the burner.

2. Apparatus as in claim 1 wherein said flame is a pilot flame, said burner is a pilot burner, said electronic circuit means are electronic logic circuit means and said battery provides power to said electronic logic circuit means.

3. Apparatus as in claim 2 wherein said gas burning fireplace includes a thermopile for generating a control voltage when it is heated and transmission means for applying the control voltage to valve control means for holding open a gas flow valve and wherein said electronic circuit means operates to cause an interruption in said transmission means when there is no current between the rod and the pilot burner.

4. Apparatus as in claim 3 wherein said fireplace further comprises generating means for producing a high voltage, conductor means for applying the high voltage to the rod and switch means for selectively enabling a connection between said generating means and said rod via said conductor.

5. Apparatus as in claim 4 further comprising electronic timing means for causing said interruption to be effective for a predetermined time interval.

* * * * *